US005083795A

United States Patent [19]

Severson

[11] Patent Number: 5,083,795

[45] Date of Patent: Jan. 28, 1992

[54] GLOBE CHANCE DEVICE FOR BINGO-TYPE GAME

[76] Inventor: Julane Severson, 2421 Kraft, S. St. Paul, Minn. 55075

[21] Appl. No.: 599,496

[22] Filed: Oct. 18, 1990

[51] Int. Cl.[5] ..... A63F 3/06

[52] U.S. Cl. ..... 273/269; 273/142 J; 434/131

[58] Field of Search ..... 273/251, 252, 269, 280, 273/287, 138 R, 142 R, 142 J, 142 JA, 142 JC; 434/131, 139, 146

[56] References Cited

U.S. PATENT DOCUMENTS 387,957 8/1888 Moreon et al. ..... 434/146

2,399,902 5/1946 Wood ..... 273/252

FOREIGN PATENT DOCUMENTS 0004035 2/1884 Fed. Rep. of Germany ..... 434/131

*Primary Examiner*—Edward M. Coven

*Assistant Examiner*—William M. Pierce

*Attorney, Agent, or Firm*—Thomas B. Tate

[57] ABSTRACT

The invention is a game called "Globespin". A globe serves as the gameboard, and other playing pieces include a clothespin which has an adhesive decal attached as a pointer, a deck of cards, a die, and a plurality of tokens which are used as markers. The object of the game is to score a Bingo pattern in any direction on the playing cards, with the position of the markers being determined by spins of the globe.

1 Claim, 3 Drawing Sheets

GLOBE CHANCE DEVICE FOR BINGO-TYPE GAME

SUMMARY OF THE INVENTION

Most geography-travel type games use a flat gameboard with some type of map drawn on it. Various Bingo-type games exist but none are known to be combined with a geography-type game.

The present invention uses a globe as the gameboard to play a combination geographical-Bingo game. Another novel feature of the invention is a clothespin with decal attached as a pointer to determine locations on the globe.

A primary object of the invention is to provide a game which is both fun and educational.

DESCRIPTION OF THE INVENTION

Figure 1:
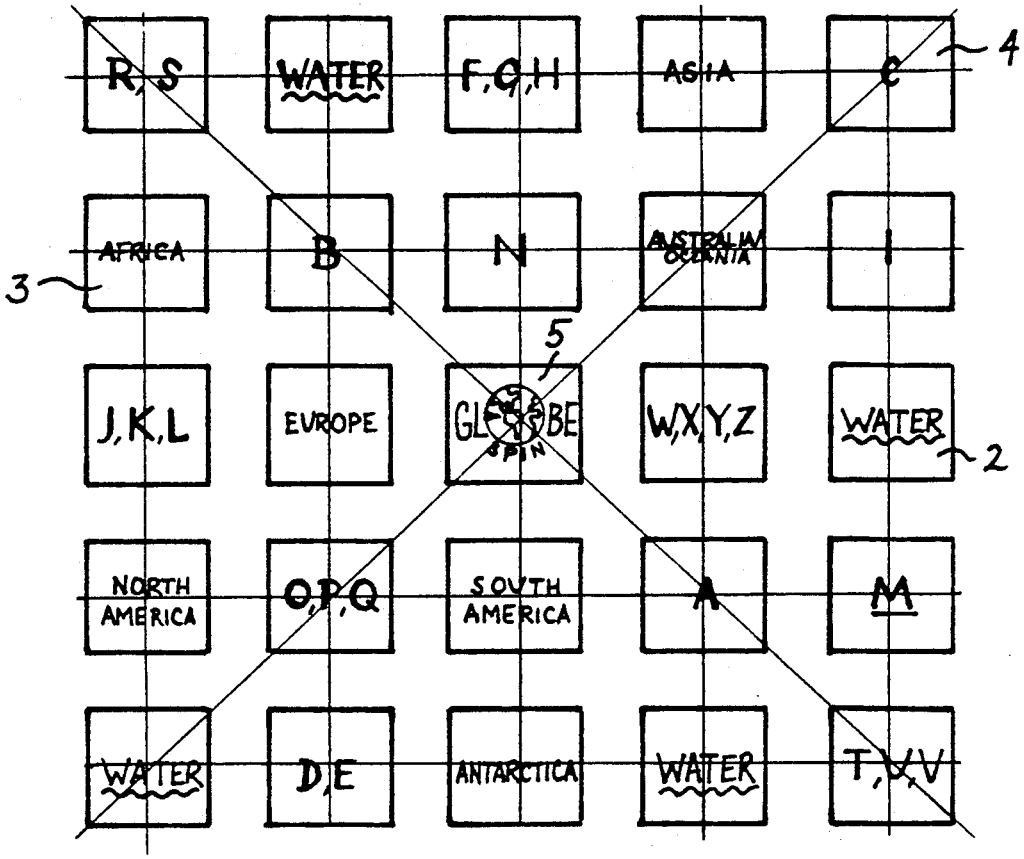
FIG. 1 shows a typical layout of cards and the possible ways to score a Bingo.

The invention is a game called "Globespin" which uses a globe 1 as the gameboard to play a Bingo-type game. Other playing pieces include a card deck which contains four water cards 2, seven continent cards 3, thirteen letter cards 4, one Globespin card 5, and one latitude location card 6, a plurality of tokens 7, a die 8, and a Globespin Clothespin 9.

The clothespin 9 is provided with a pointer decal 10. The pointer 10 is fitted and applied as follows:

Step 1: Remove one adhesive strip approximately 3¼" long by ¼" wide from its backing.

Figure 2:
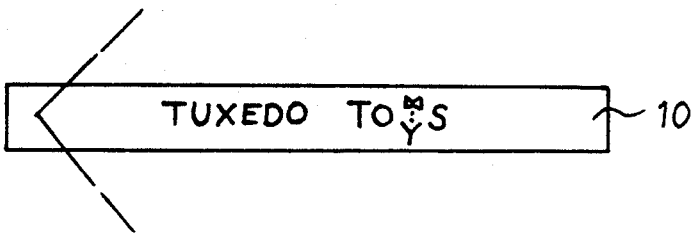
FIG. 2 shows the pointer decal before it has been cut and trimmed to a point.
Figure 3:
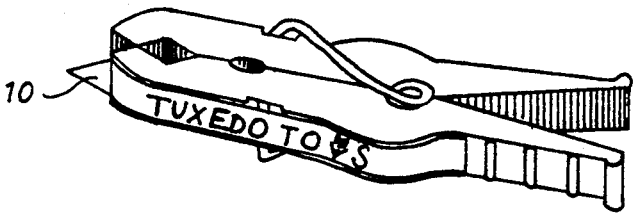
FIG. 3 shows the Globespin Clothespin with pointer decal attached.
Figure 4:
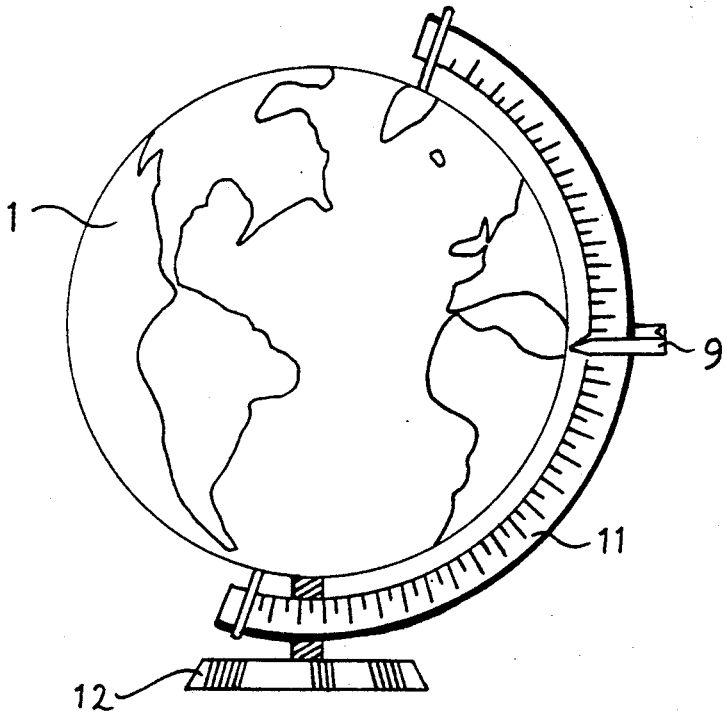
FIG. 4 shows the globe with Globespin Clothespin attached to the meridian of the globe.
Figure 5:
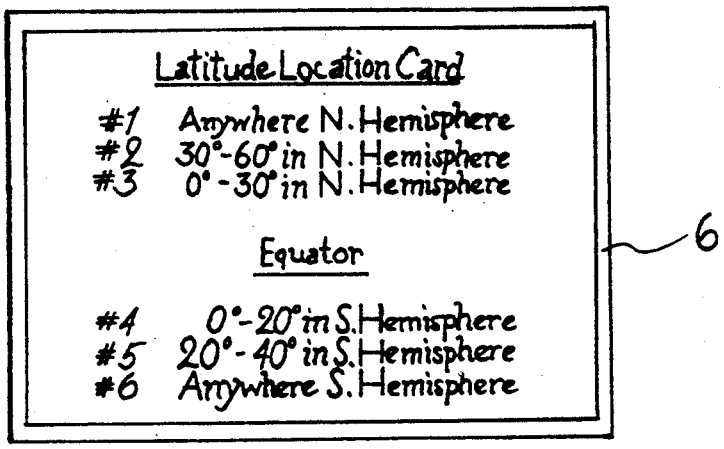
FIG. 5 shows miscellaneous playing pieces, namely the latitude location card, the tokens, and the die, which are used in the game.
Figure 5:
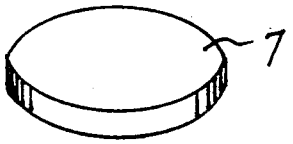
Figure 5:
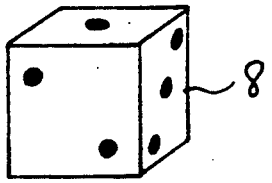

Step 2: Fold back along the solid line indicated in FIG. 2, approximately ⅜" from the left end of the strip.

Step 3: Trim to a point along the dotted lines indicated in FIG. 2.

Step 4: Apply to clothespin 9 by having the point extending over the edge.

Step 5: Trim the point as needed to adjust to the particular globe 1 being used in the game.

The game is played as follows:

Each player selects a plurality of tokens 7 of a different color from the other players' tokens. The water cards 2, continent cards 3, and letter cards 4 are shuffled and then placed in five rows of five cards each, with the Globespin card 5 in the center. Each player places a token 7 on the Globespin card 5, which is a free space.

The arrangement of the remaining cards shown in FIG. 1 is only one of many possible combinations.

Each player throws the die 8 to determine who goes first. The first player then shakes the die 8 to determine where to place the Globespin Clothespin 9 on the meridian 11 of the globe 1. The number rolled on the die 8 is matched to the corresponding range of degrees of the latitude location card 6 as follows: One on die is anywhere N of equator, 2 is 30'-60' N, 3 is 0'-30' N, 4 is 0'-20' S, 5 is 20'-40' S, and 6 is anywhere S of equator.

The player then spins the globe 1, holding it firmly at the base 12, so that the globe 1 must make at least one complete revolution. After the globe 1 stops spinning, if the pointer 10 points to a country, state, or island, the player calls out its name and then places a token 7 on the letter card 4 which represents the initial letter of the name of the country, state (the U.S. may be identified by each individual state or as the United States), or island, or alternatively, upon the continent card 3 where that country is located. For example, if the pointer 10 points to France, the player can place a token 7 on either the F card or the Europe card. If the pointer 10 points to water, the player calls out the body of water and places a token 7 on any of the four water cards 2. Once a player has placed a token on each of the four water cards and lands in the water again, he forfeits his turn.

Each player may place only one token per card; thus each card may have up to four different colored tokens.

Play then moves to the next player who shakes the die 8 to determine where to place the Globespin Clothespin 9. He spins the globe 1, calls out location, and places his token 7 on the appropriate card. Play continues until one player gets a Bingo pattern in any direction (horizontal, vertical, or diagonal).

I claim:

1. A game comprising:

a globe used as the game board, said glove having a half-meridian;

pointer means attachable to said half-meridian of said globe, said pointer means comprising a clothespin which has an adhesive decal affixed thereon, said decal having been cut and trimmed to a point;

indicia and chance means for determining where to attach said pointer means, said indicia comprising a latitude location card and said chance means comprising a die;

a plurality of indicia representing various geographical entities;

a plurality of indicia representing letters of the alphabet;

a plurality of markers;

wherein the object of the game is to spin said globe, using said pointer means to locate various geographical entities, and to place said markers upon said indicia representing said geographical entities or the initial letter thereof, the winner being the player who first places markers upon each of the indicia in a horizontal, vertical, or diagonal row.

* * * * *